US009805923B2

(12) United States Patent
Goodwin et al.

(10) Patent No.: US 9,805,923 B2
(45) Date of Patent: Oct. 31, 2017

(54) MASS SEPARATORS, MASS SELECTIVE DETECTORS, AND METHODS FOR OPTIMIZING MASS SEPARATION WITHIN MASS SELECTIVE DETECTORS

(71) Applicant: FLIR Detection, Inc., Stillwater, OK (US)

(72) Inventors: Michael Goodwin, Brookline, MA (US); James Mitchell Wells, Lafayette, IN (US)

(73) Assignee: FLIR Detection, Inc., Stillwater, OK (US)

( * ) Notice: Subject to any disclaimer, the term of this patent is extended or adjusted under 35 U.S.C. 154(b) by 0 days.

(21) Appl. No.: 14/711,677

(22) Filed: May 13, 2015

(65) Prior Publication Data

US 2015/0332905 A1 Nov. 19, 2015

Related U.S. Application Data

(60) Provisional application No. 61/994,778, filed on May 16, 2014.

(51) Int. Cl.
*H01J 49/42* (2006.01)
*H01J 49/06* (2006.01)
(Continued)

(52) U.S. Cl.
CPC ..... *H01J 49/4255* (2013.01); *H01J 49/0031* (2013.01); *H01J 49/06* (2013.01);
(Continued)

(58) Field of Classification Search
CPC .... H01J 49/0027; H01J 49/0031; H01J 49/06; H01J 49/062; H01J 49/063; H01J 49/067;
(Continued)

(56) References Cited

U.S. PATENT DOCUMENTS 5,420,425 A * 5/1995 Bier ..... H01J 49/423 250/282
2007/0176094 A1* 8/2007 Wells ..... H01J 49/4225 250/292

(Continued)

OTHER PUBLICATIONS

Hager, James W., "A new linear ion trap mass spectrometer", Rapid Communications in Mass Spectrometry, 2002, 16, 512.

(Continued)

*Primary Examiner* — David E Smith
(74) *Attorney, Agent, or Firm* — Wells St. John P.S.

(57) ABSTRACT

Mass separators are provided that can include at least one electrode component having a surface, in one cross section, defining at least two runs associated via at least one rise, the rise being orthogonally related to the runs. Mass selective detectors are provided that can include at least a first pair of opposing electrodes with each of the opposing electrodes having a complimentary surface, in one cross section, defining at least two runs associated via a rise. Methods for optimizing mass separation within a mass selective detector are also provided, including providing mass separation parameters; providing one set electrodes within the separator having a surface operatively aligned within the separator, the surface, in one cross section, defining at least two runs associated via a rise, the rise being orthogonally related to the runs; and modifying one or both of the rise and/or runs to achieve the mass separation parameters.

20 Claims, 13 Drawing Sheets

(51) Int. Cl.
*H01J 49/26* (2006.01)
*H01J 49/00* (2006.01)

(52) U.S. Cl.
CPC ..... *H01J 49/26* (2013.01); *H01J 49/423* (2013.01); *H01J 49/4215* (2013.01)

(58) Field of Classification Search
CPC ..... H01J 49/068; H01J 49/26; H01J 49/42; H01J 49/421; H01J 49/4215
See application file for complete search history.

(56) References Cited

U.S. PATENT DOCUMENTS

2009/0321624 A1* 12/2009 Fang ..... H01J 49/004 250/281
2014/0087063 A1* 3/2014 Mu ..... H01J 49/063 427/98.5

OTHER PUBLICATIONS

Schwartz, Jae C., et al., "A Two-Dimensional Quadrupole Ion Trap Mass Spectrometer", Journal of the American Society for Mass Spectrometry, 2002, 13, 659-669.
Douglas, Donald J., et al., "Linear Ion Traps in Mass Spectrometry", Mass Spectrometry Reviews, 2005, 24, 1-29.
Ouyang, Zheng, et al., "Rectilinear Ion Trap: Concepts, Calculations, and Analytical Performance of a New Mass Analyzer", Analytical Chemistry, 2004, 76, 4595-4605.
Tallapragada, Pavan K., et al., "Geometry Optimization of Axially Symmetric Ion Traps", International Journal of Mass Spectrometry, 2007, 264, 38-52.
Wells, J. Mitchell, et al., "A Quadrupole Ion Trap with Cylindrical Geometry Operated in the Mass-Selective Instability Mode", Analytical Chemistry, 1998, 70, 438-444.

* cited by examiner

A8

MASS SEPARATORS, MASS SELECTIVE DETECTORS, AND METHODS FOR OPTIMIZING MASS SEPARATION WITHIN MASS SELECTIVE DETECTORS

CROSS REFERENCE TO RELATED APPLICATION

This application claims priority to U.S. Provisional Patent Application Ser. No. 61/994,778 which was filed on May 16, 2014, the entirety of which is incorporated by reference herein.

STATEMENT AS TO RIGHTS TO INVENTIONS MADE UNDER FEDERALLY-SPONSORED RESEARCH AND DEVELOPMENT

This invention was made with Government support under CRAD Project DHS Contract HSHQDC-09-C-00057 awarded by the U.S. Department of Homeland Security. The Government has certain rights in the invention.

TECHNICAL FIELD

The technical field is mass analysis, and in particular embodiments, the present disclosure relates to mass separators, mass selective detectors, and methods for optimizing mass separation within mass selective detectors.

BACKGROUND

Typical mass selective detectors can include ion trap mass selectors and/or mass filters. The electric field within these ion traps such as typical hyperbolic traps can be fine-tuned by adjusting the electrode spacing and/or hyperbolic angle of electrodes within the trap. This limited adjustability creates a challenge when optimizing the electric field created within the filter and hence, the performance of the mass selective detector. The present disclosure provides mass separators, mass selective detectors, and methods for optimizing mass separation within mass selective detectors. These separators, detectors, and/or methods can utilize and/or provide novel geometries that can be utilized and/or modified to optimize electric fields created within the mass selective detector.

SUMMARY OF THE DISCLOSURE

Mass separators are provided that can include at least one electrode component having a surface operatively aligned within the separator, the surface, in one cross section, defining at least two runs associated via at least one rise, the rise being orthogonally related to the runs.

Mass selective detectors are provided that can include at least a first pair of opposing electrodes, each of the opposing electrodes having a complimentary surface, the surface, in one cross section, defining at least two runs associated via a rise, the rise being orthogonally related to the runs.

Methods for optimizing mass separation within a mass selective detector are also provided. The methods can include providing mass separation parameters; providing one set electrodes within the separator having a surface operatively aligned within the separator, the surface, in one cross section, defining at least two runs associated via a rise, the rise being orthogonally related to the runs; and modifying one or both of the rise and/or runs to achieve the mass separation parameters.

DRAWINGS

Embodiments of the disclosure are described below with reference to the following accompanying drawings.

Figure 6A:
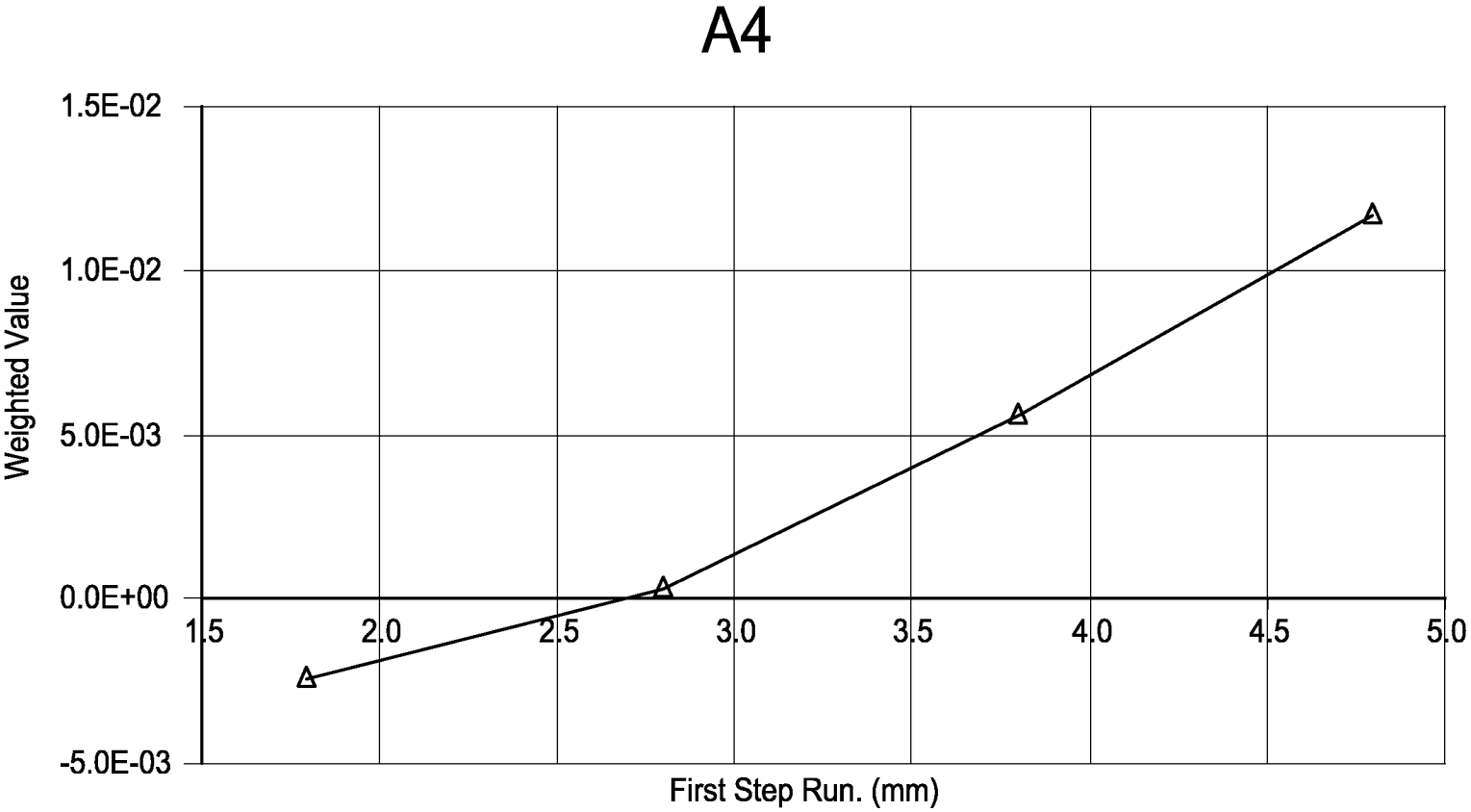
Figure 6B:
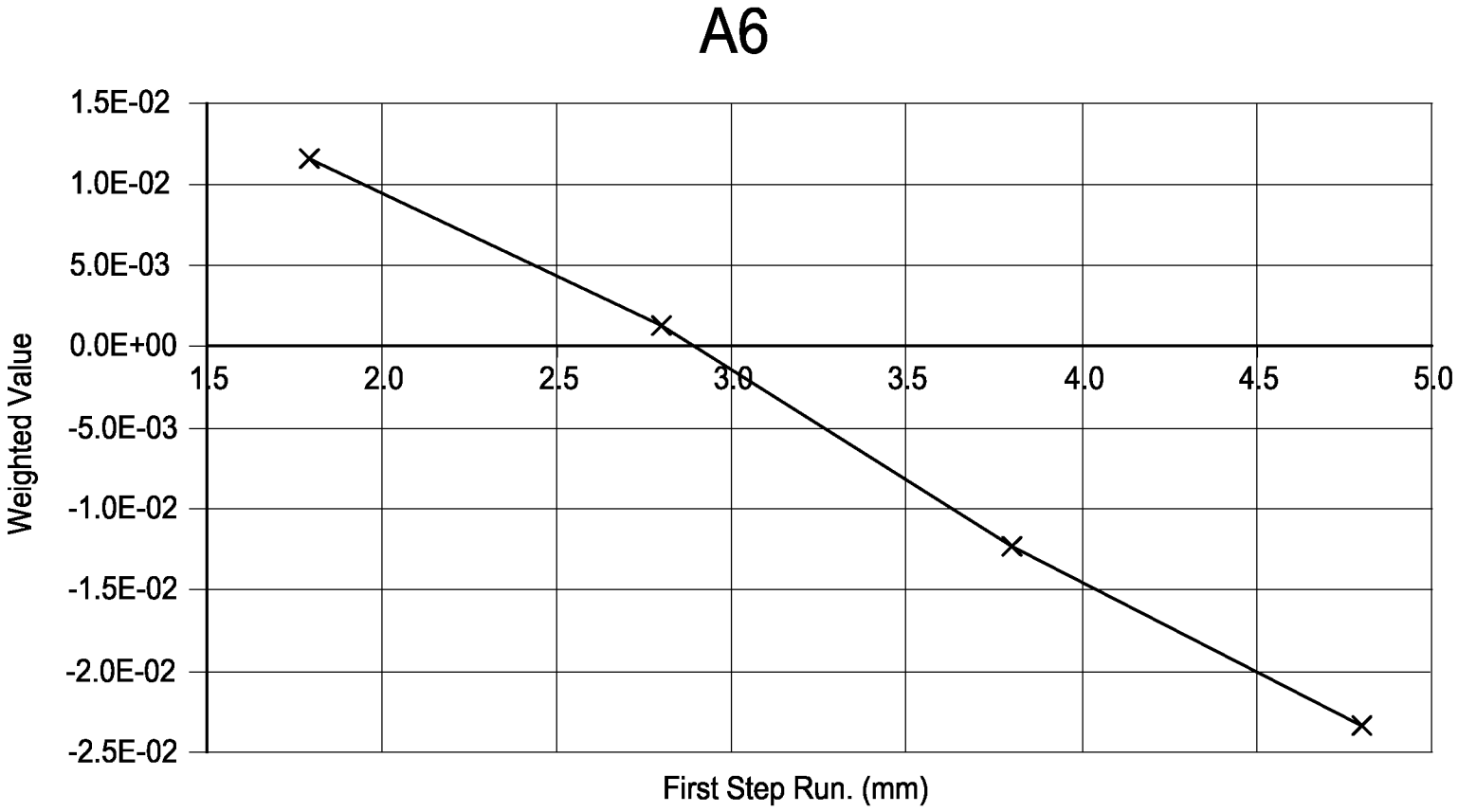
Figure 6C:
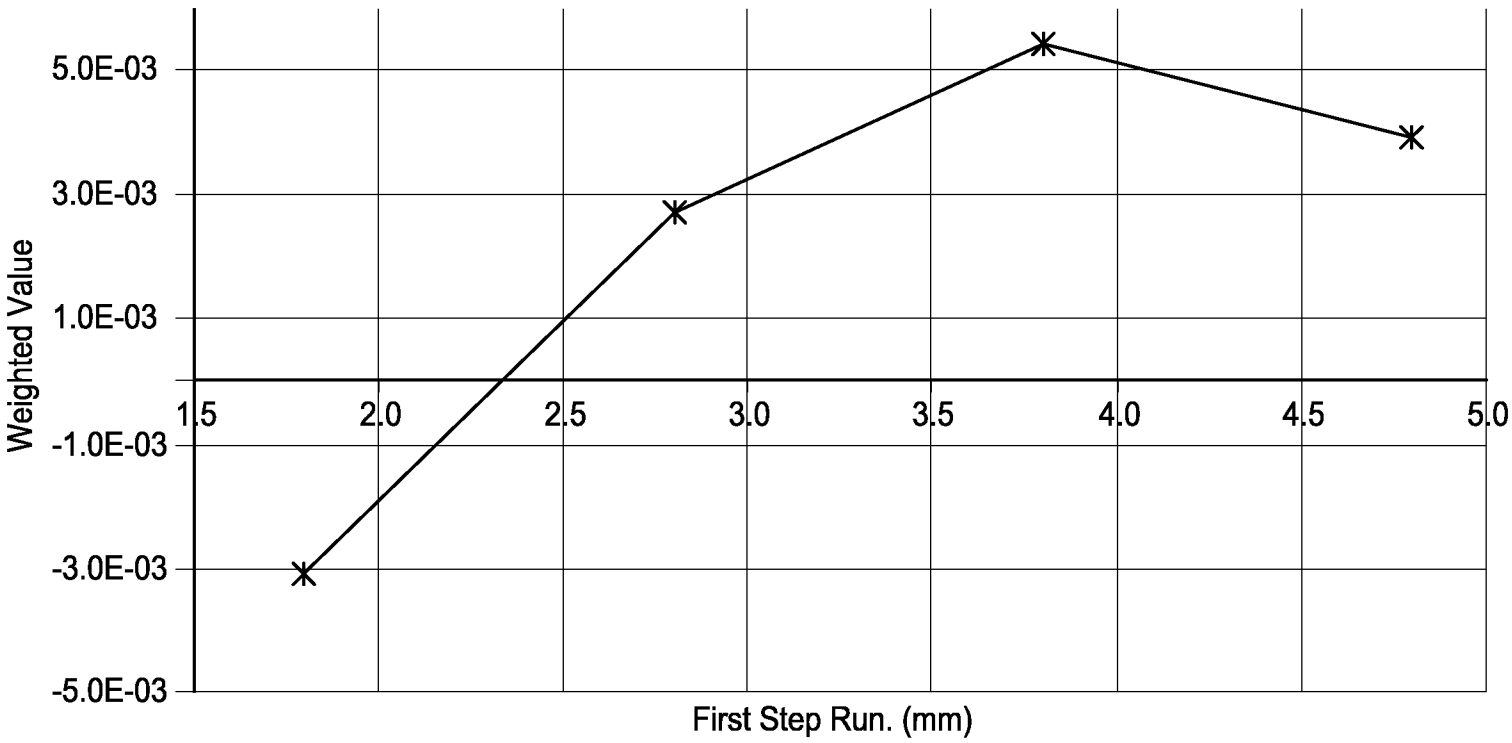

FIGS. 6A, 6B, and 6C are data demonstrating the effect of altering the width of the first run of an electrode geometry on higher-order electric fields according to an embodiment.

Figure 7A:
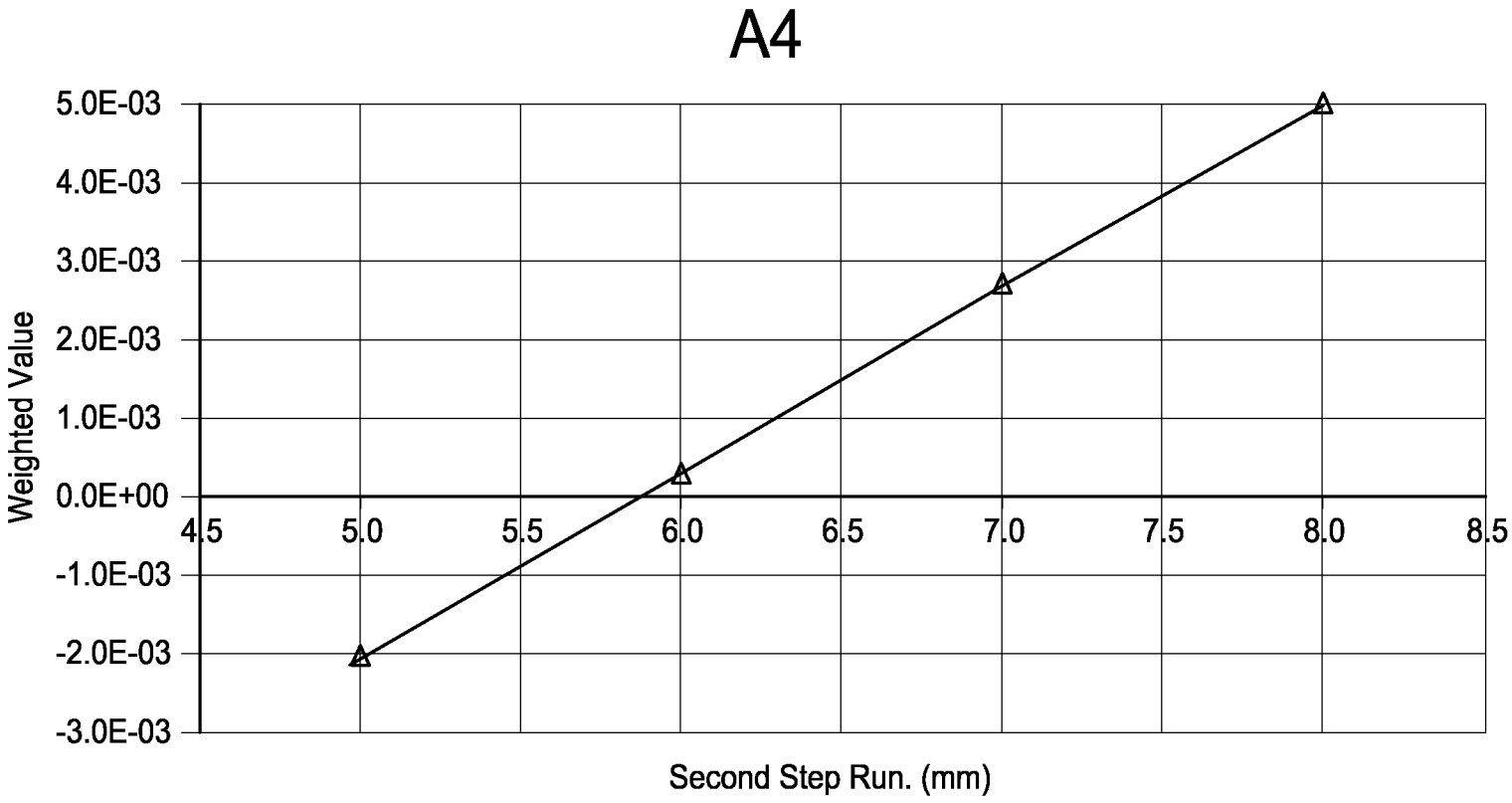
Figure 7B:
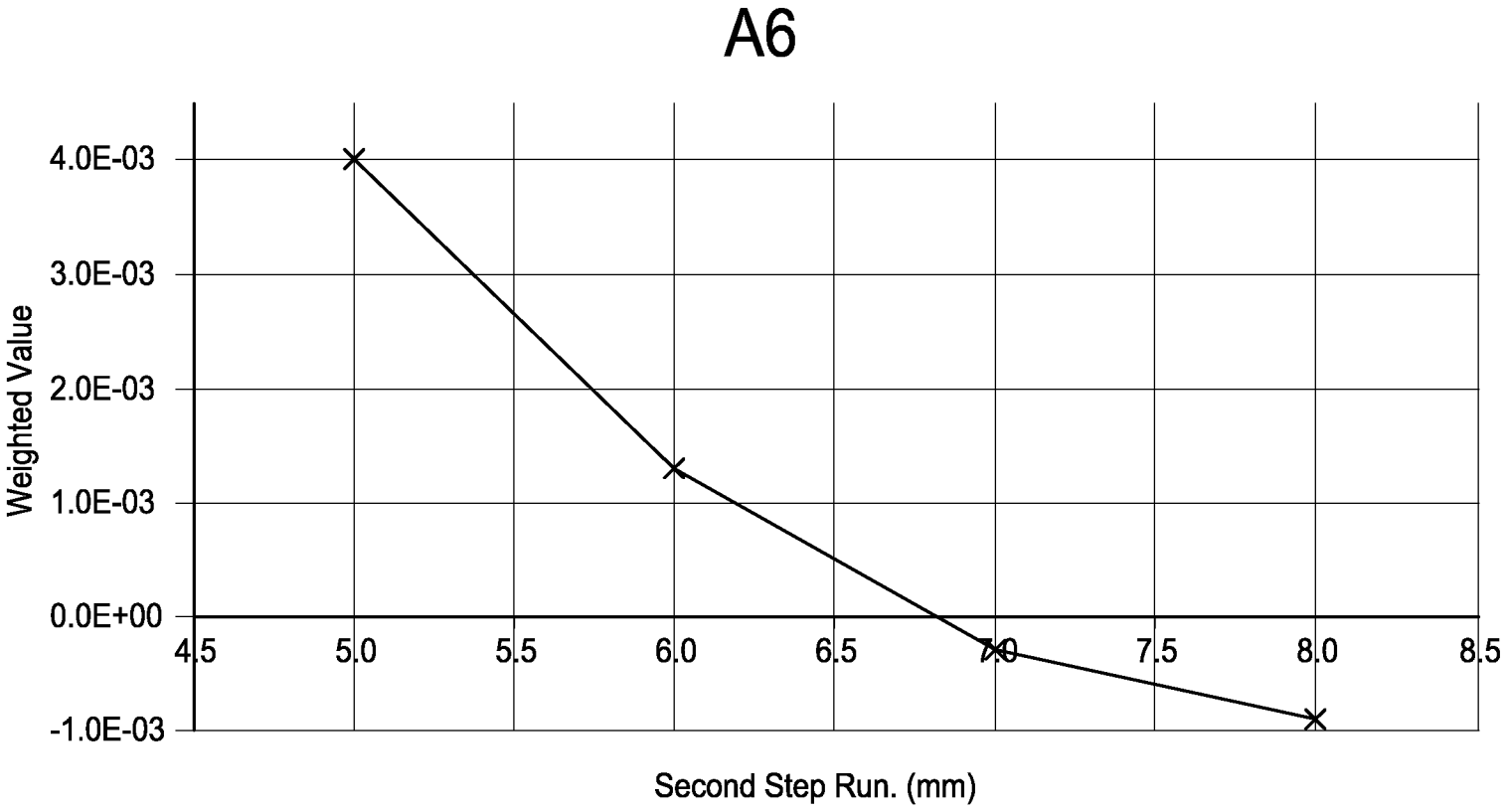
Figure 7C:
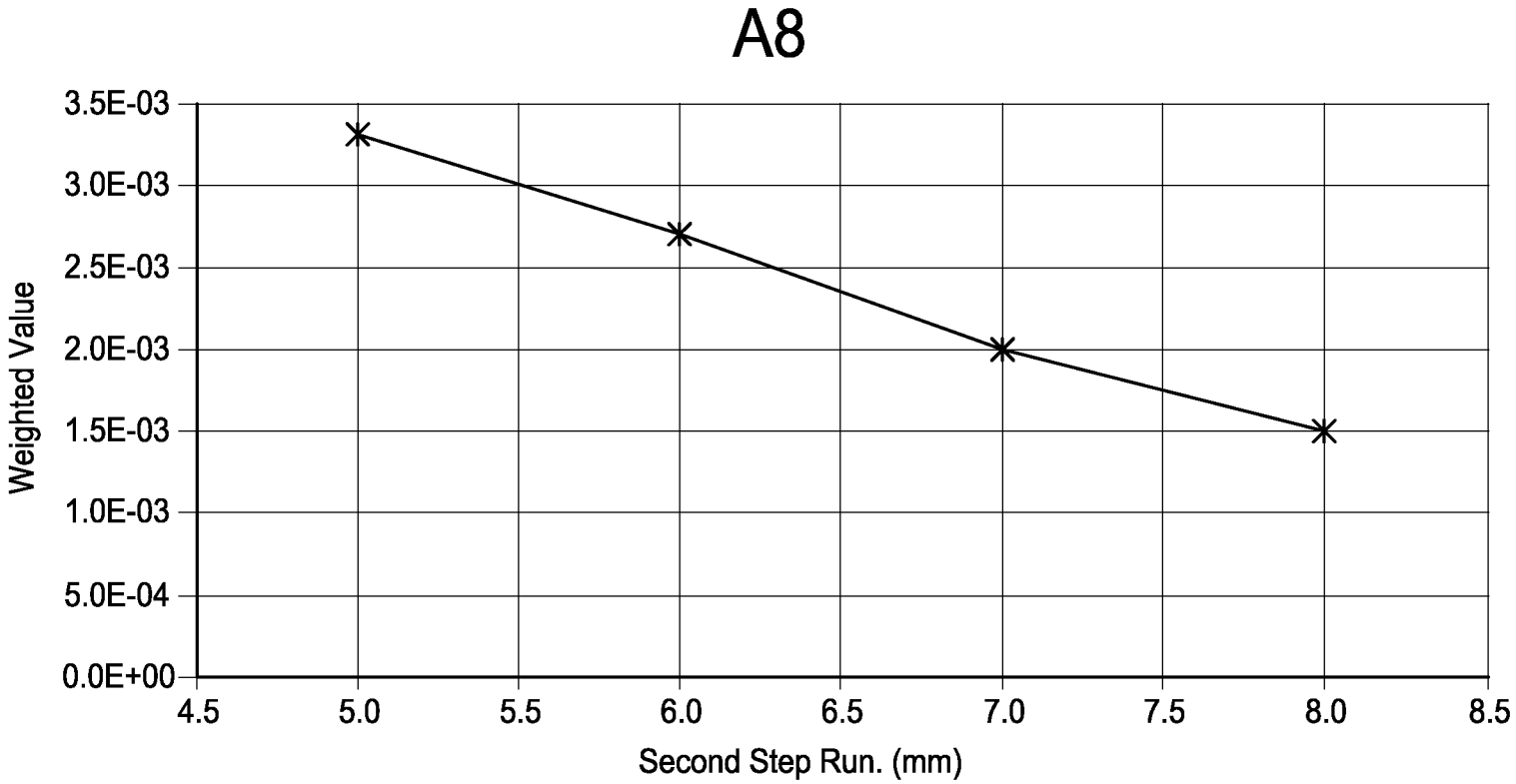

FIGS. 7A, 7B, and 7C are data demonstrating the effect of altering the width of another run of an electrode geometry on higher-order electric fields.

Figure 8A:
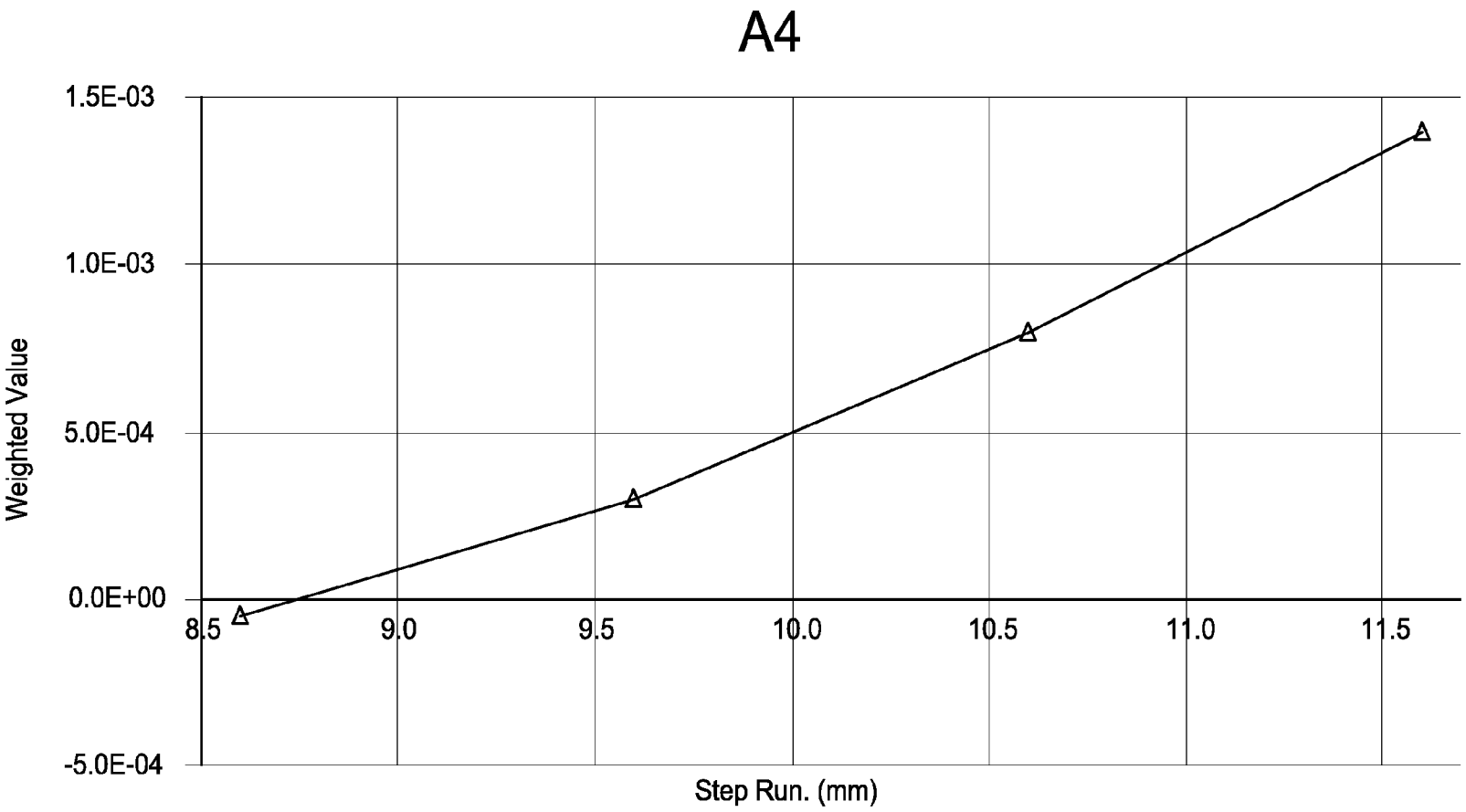
Figure 8B:
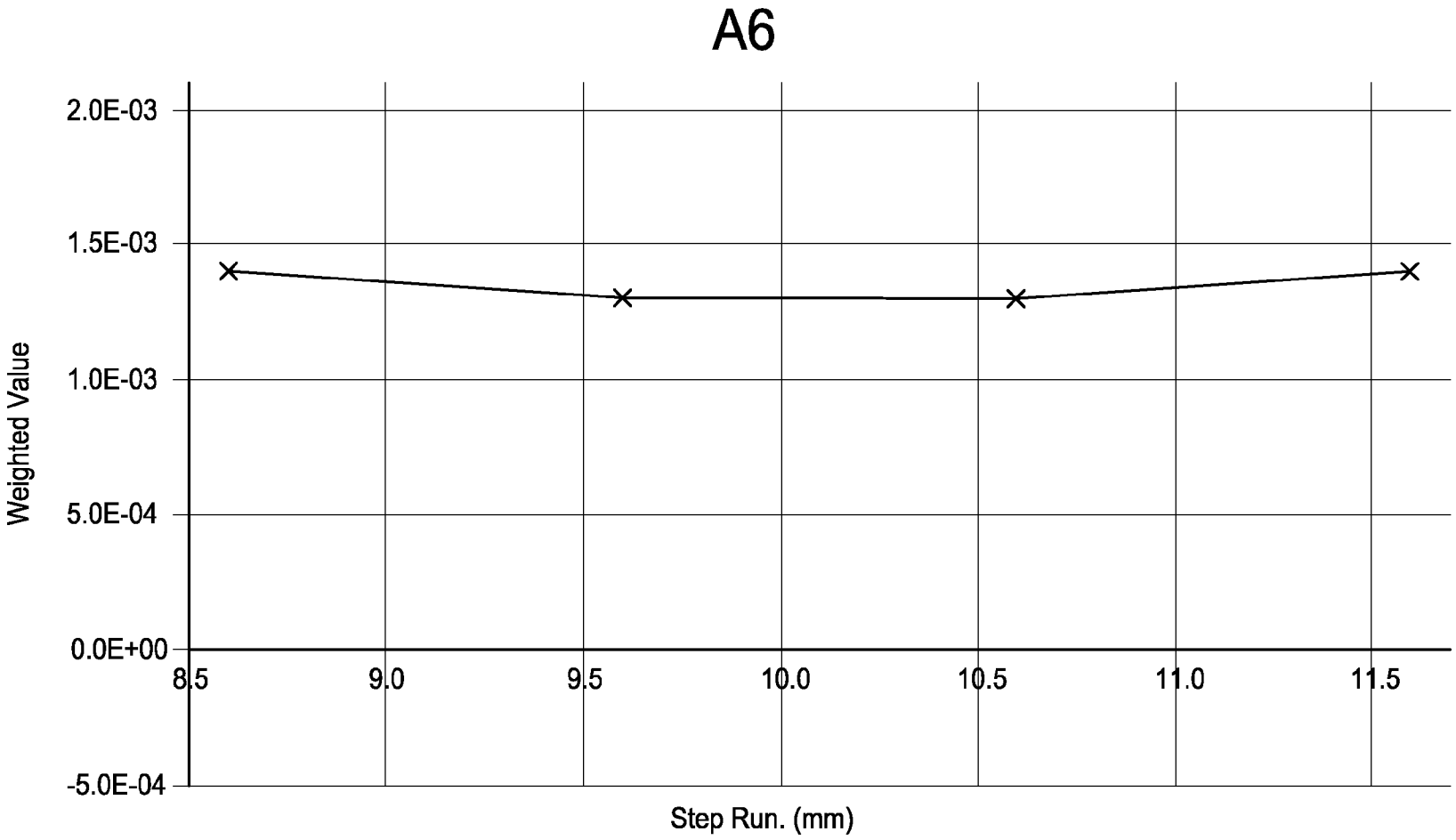
Figure 8C:
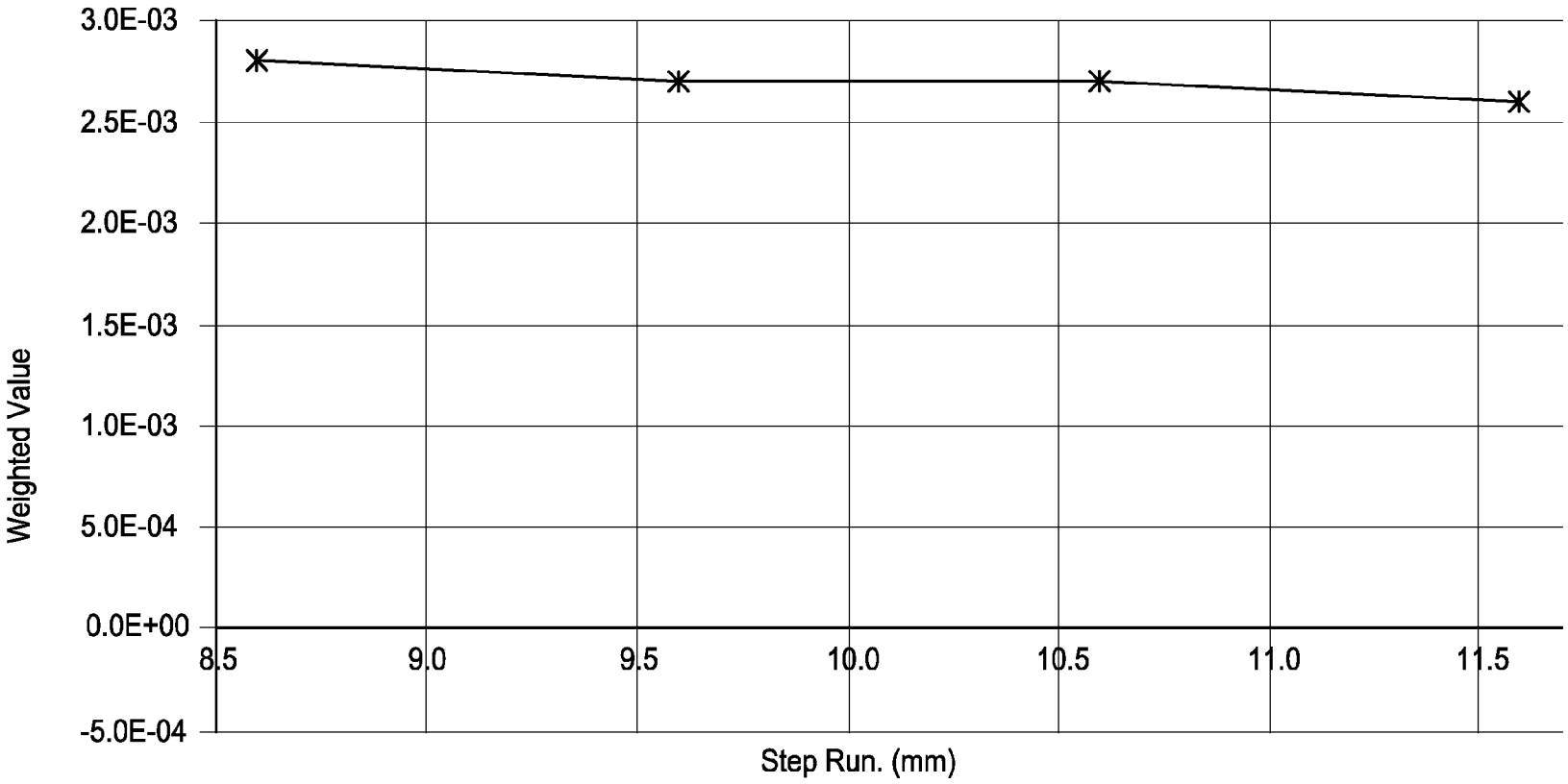

FIGS. 8A, 8B and 8C are data demonstrating the effect of altering the width of another run of the electrode geometry on higher-order electric fields.

DESCRIPTION

This disclosure is submitted in furtherance of the constitutional purposes of the U.S. Patent Laws "to promote the progress of science and useful arts" (Article 1, Section 8).

Figure 1:
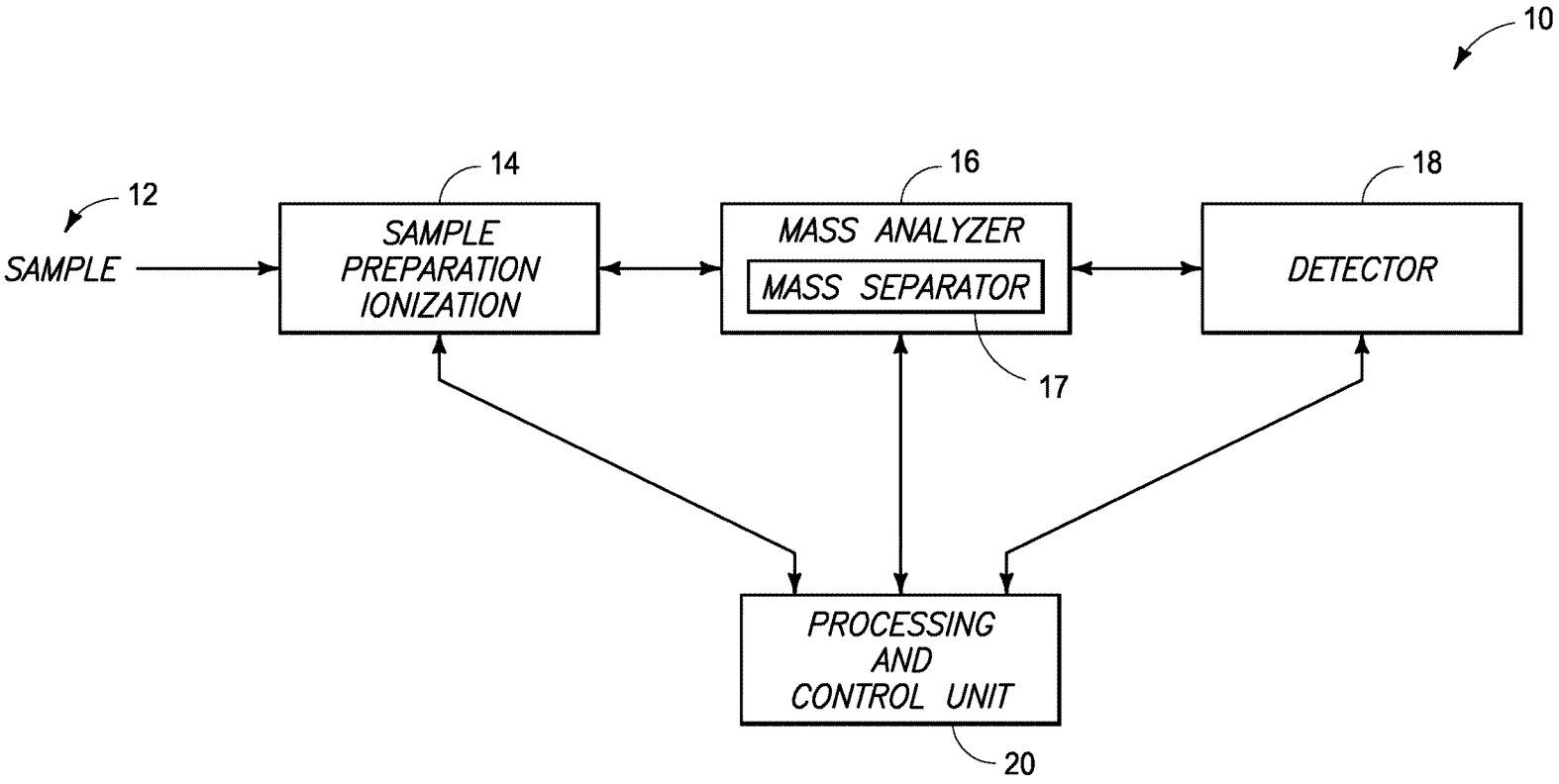
FIG. 1 is a block diagram of a mass spectrometer according to an embodiment of the disclosure.

The present disclosure will be described with reference to FIGS. 1-8C. Referring first to FIG. 1, a block diagram of a mass spectrometry instrument 10 is shown. Mass spectrometry instrument 10 includes a sample preparation ionization section 14 configured to receive a sample 12 and convey a prepared and/or ionized sample to a mass analyzer 16. Mass analyzer 16 can be configured to separate ionized samples for detection by detector 18. Mass analyzer 16 can include but is not limited to mass selection, mass filter, and/or mass separators.

As depicted in FIG. 1, a sample 12 can be introduced into section 14. For purposes of this disclosure, sample 12 represents any chemical composition including both inorganic and organic substances in solid, liquid and/or vapor form. Specific examples of sample 12 suitable for analysis include volatile compounds such as, toluene or the specific examples include highly-complex non-volatile protein based structures such as, bradykinin. In certain aspects, sample 12 can be a mixture containing more than one substance or in other aspects sample 12 can be a substantially pure substance. Analysis of sample 12 can be performed according to exemplary aspects described below.

Sample preparation ionization section 14 can include an inlet system (not shown) and an ion source (not shown). The inlet system can introduce an amount of sample 12 into instrument 10. Depending upon sample 12, the inlet system may be configured to prepare sample 12 for ionization. Types of inlet systems can include batch inlets, direct probe inlets, chromatographic inlets, and permeable or capillary membrane inlets. The inlet system may include means for preparing sample 12 for analysis in the gas, liquid and/or solid phase. In some aspects, the inlet system may be combined with the ion source.

The ion source can be configured to receive sample 12 and convert components of sample 12 into analyte ions. This conversion can include the bombardment of components of sample 12 with electrons, ions, molecules, and/or photons. This conversion can also be performed by thermal or electrical energy.

The ion source may utilize, for example, electron ionization (EI, typically suitable for the gas phase ionization), photo ionization (PI), chemical ionization, collisionally activated disassociation and/or electrospray ionization (ESI). For example in PI, the photo energy can be varied to vary the internal energy of the sample. Also, when utilizing ESI, the sample can be energized under atmospheric pressure and potentials applied when transporting ions from atmospheric pressure into the vacuum of the mass spectrometer can be varied to cause varying degrees of dissociation.

Analytes can proceed to mass analyzer 16. Mass analyzer 16 can include an ion transport gate (not shown), and a mass separator 17. The ion transport gate can contain a means for gating the analyte beam generated by the ion source.

Mass separator 17 can include but is not limited to the mass separators and/or mass detectors described herein and may well include the use of the electrodes described herein.

Analytes may proceed to detector 18. Exemplary detectors include electron multipliers, Faraday cup collectors, photographic and stimulation-type detectors. The progression from analysis from sample preparation 14 to detector 18 can be controlled and monitored by a processing and control unit 20.

Acquisition and generation of data according to the present invention can be facilitated with processing and control unit 20. Processing and control unit 20 can be a computer or mini-computer that is capable of controlling the various elements of instrument 10. This control includes the specific application of RF and DC voltages and may further include determining, storing and ultimately displaying mass spectra. Processing and control unit 20 can contain data acquisition and searching software. In one aspect such data acquisition and searching software can be configured to perform data acquisition and searching that includes the programmed acquisition of the total analyte count described above. In another aspect, data acquisition and searching parameters can include methods for correlating the amount of analytes generated to predetermined programs for acquiring data.

Figure 2A:
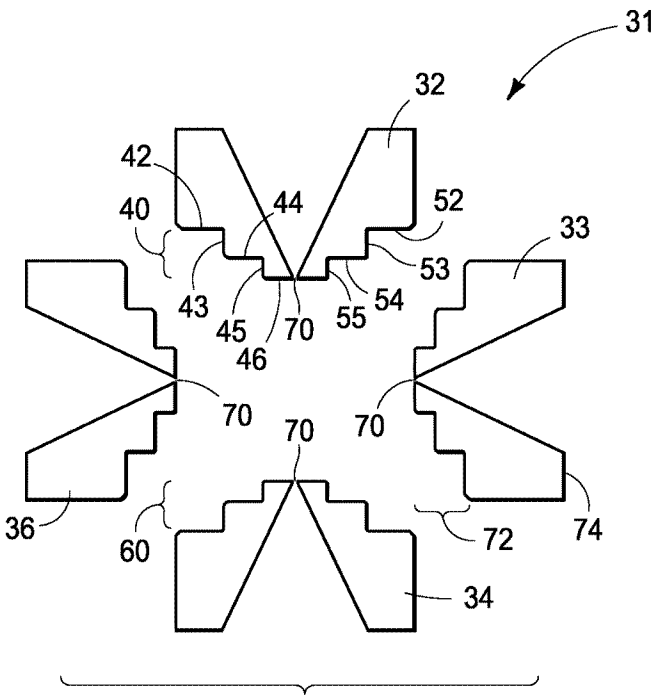
FIGS. 2 and 2A depict cross-sections of electrodes according to an embodiment of the disclosure.
Figure 2:
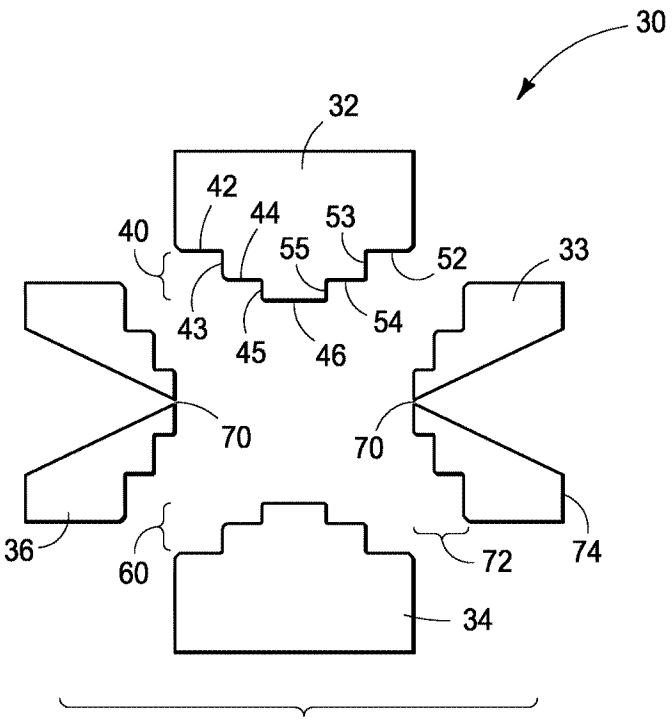

Referring to FIGS. 2 and 2A, cross sections of sets of electrodes 30 and 31 are shown. These sets of electrodes can be part of mass separator 17 and utilized as part of a mass spectrometer as described herein, for example. As shown, set 30 includes four electrodes: 32, 33, 34, and 36. Pairs of these electrodes, such as electrodes 33 and 36, can be arranged opposing one another as can pairs of electrodes such as pairs 32 and 34 can be arranged opposing one another. Individual ones of the electrodes such as electrode 32, for example, can include a surface 40, and this surface can define at least two runs, such as runs 42 and 44, associated via at least one rise 43.

The rise 43 can be orthogonally related to runs 42 and 44. In accordance with example implementations, electrode 32 can include an additional rise 45 that is orthogonally related to an additional run 46, for example. As can be seen, the electrode 32 can include a complimentary set of rises and runs such as rises and runs 52, 53, 54, and 55. As shown, these rises and runs can be complimentary in height and/or width, for example.

In accordance with example implementations, these rises and runs can establish a series of pedestals extending from electrode 32. As an example, these pedestals can include a combination of runs 44 and 54 to establish one pedestal, and another pedestal established as run 46. The combination of rises and runs can terminate in the final run 46. In accordance with example implementations, runs 42 and 52 can be considered a first step in the electrode surface. Runs 44 and 54 can be considered a second step in the electrode surface, and run 46 can be considered a third step in the electrode surface. In accordance with example implementations, electrode 34 can have a surface 60 that defines complimentary rises and runs to that of opposing electrode 32.

In accordance with additional embodiments, electrodes 33 and 36 can define an opening that extends from one surface 72 of electrode 33 to an opposing surface 74. Electrode 36 can be complimentary to electrode 33 and define another opening 70, for example. Electrodes 33 and 36 can also define rises and/or runs as shown as well. Electrode set 31 of FIG. 2A can include openings 70 in each electrode of the set.

Figure 3:
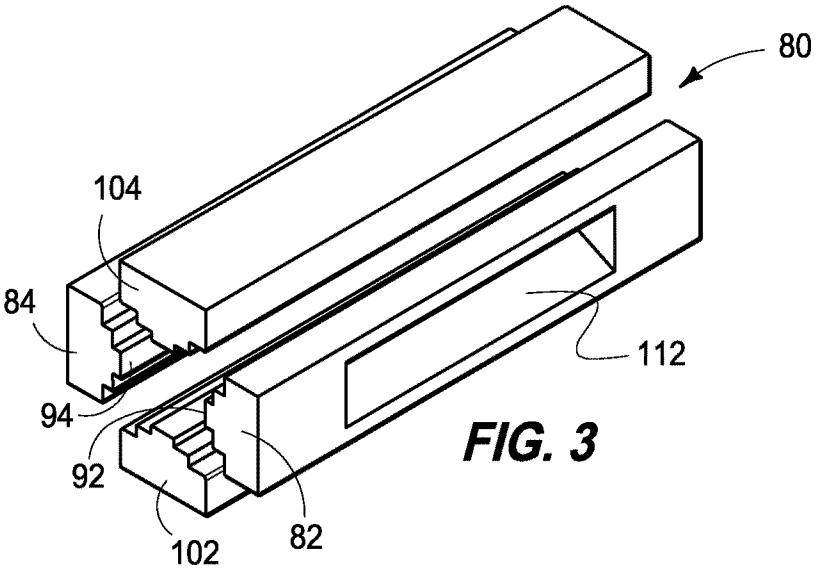
FIG. 3 is a perspective view of electrodes of a mass selective detector according to an embodiment of the disclosure.

Referring to FIG. 3, mass selective detector 80 can include a first pair of electrodes 82 and 84, with each of the opposing electrodes having a complimentary surface 92 and 94, in one cross section defining at least two runs associated via rise, with the rise being orthogonally related to the runs. The mass selective detector 80 can also include an additional pair of electrodes 102 and 104, and this second pair of electrodes can be adjacent to and orthogonally aligned with the first pair of electrodes 82 and 84 as shown in FIG. 3, for example. According to example implementations, at least one of the electrodes of detector 80 can define an opening such as electrode 82 defining opening 112. In accordance with example implementations, electrode 84 opposing electrode 82 can also include an opening not shown.

Figure 4:
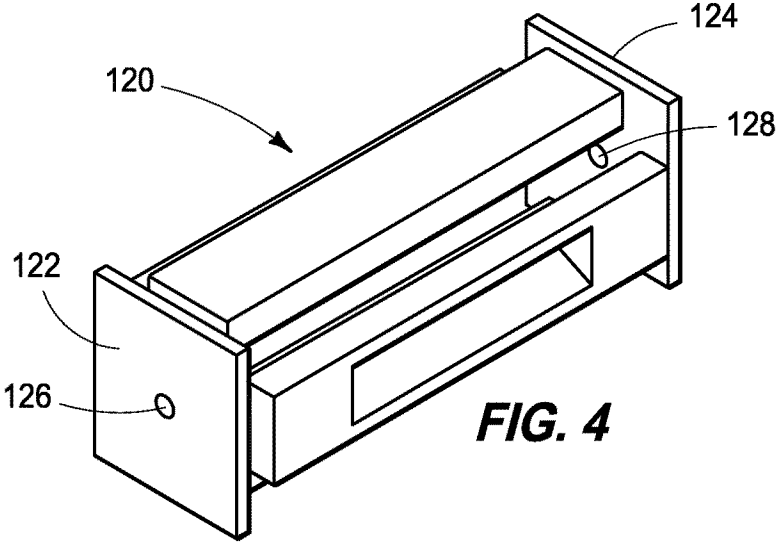
FIG. 4 is an alternative view of electrodes of a mass selective detector according to an embodiment of the disclosure.

Referring to FIG. 4, mass selective detector 120 can include sets of electrodes operatively aligned between end caps 122 and 124. One or both of end caps 122 and 124 can include an opening 126 and/or 128. In accordance with example implementations, one or more of the mass selective detectors can be configured as a linear ion trap having end caps 122 and 124. The endcaps 122 and 124 can be oriented and configured are to produce an electric field along the axis that is parallel with electrode set 120, and/or confine the ions along that axis. The endcaps and/or electrodes can be affixed in place with insulative mounting pieces such as piece or spacing block 142 in FIGS. 5A and 5B. Openings 126 and 128 can be aligned with one another along one axis that extends within a volume defined between electrodes of the detector.

Figure 5B:
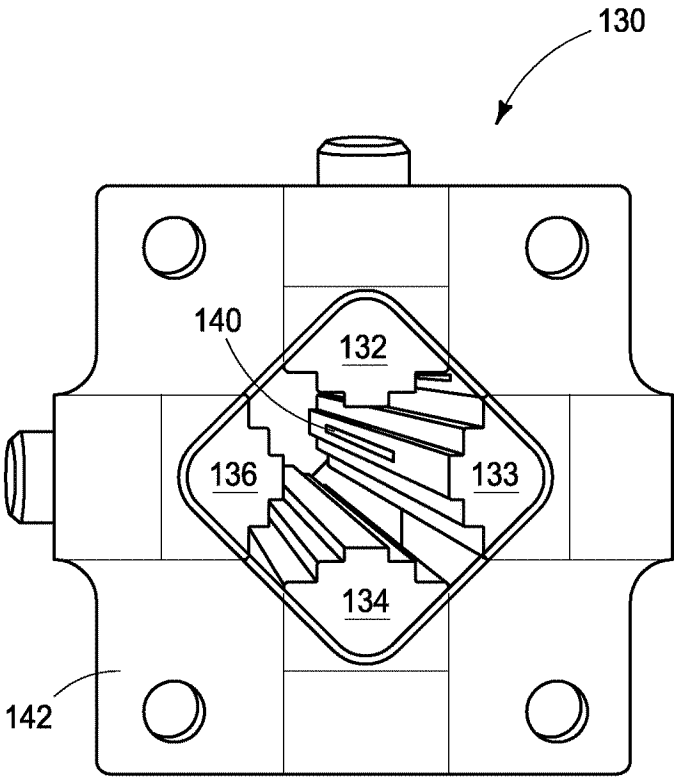
FIGS. 5A and 5B are views of still another alternative embodiment of a mass selective detector according to an embodiment of the disclosure.
Figure 5A:
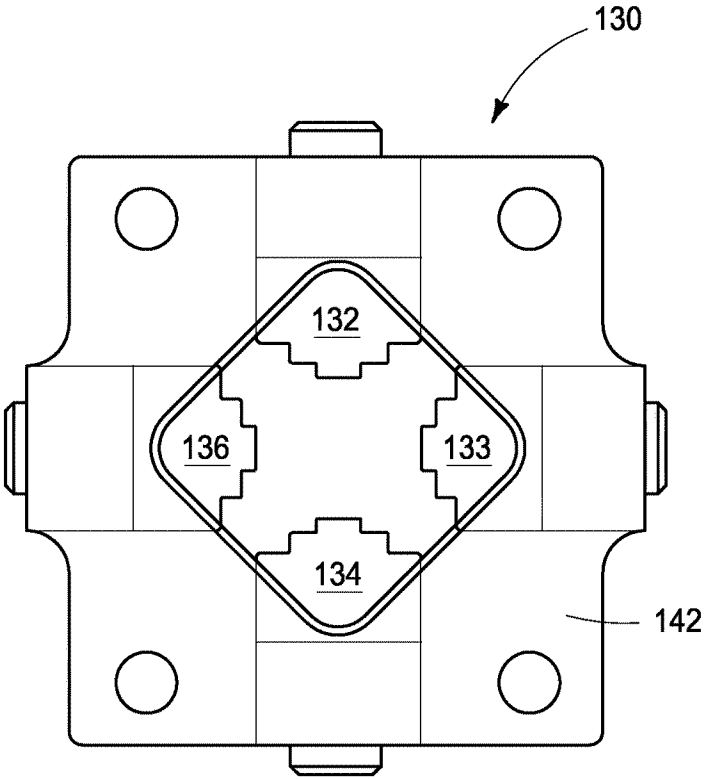

Referring next to FIGS. 5A and 5B, an alternative embodiment of a mass selective detector 130 is shown. In FIG. 5A, an elevational view of the detector assembly is shown, and in FIG. 5B, a slight perspective view of the detector assembly 130 is shown. As can be seen in these views, assembly 130 can include sets of electrodes 132, 133, 134, and 136. These electrodes have the surfaces defined herein, include step rise and/or rise or run surfaces described. Referring to FIG. 5B and the perspective view, the opening 140 within electrode 133 is depicted, and these electrodes are in orthogonal relation to one another. In accordance with example implementations, assembly 130 can also include a spacing block 142.

Analytes can be stored and/or trapped using the mass separators described herein, such as the linear ion trap through the appropriate application of radio frequency and/or direct current voltages to the electrodes. For example, and by way of example only, RF voltage can be applied to one or more of the electrodes describe herein. Ions created can be introduced into the volume defined between the electrodes. The analytes can be stored and/or trapped in an oscillating potential well created in this space by application of the RF voltage.

Further, RF and/or DC voltages can be applied to the electrodes in such a way to create an electric field within the space and trap a single (m/z) value analyte at a time. Voltages can then be stepped to the next (m/z) value, changing the electric field within the space, wherein analytes having that value are trapped and analytes having the previous value are ejected to a detector. This analysis can continue step wise to record a full mass spectrum over a desired (m/z) range. The electric fields described herein and applied thereto can be considered mass separation parameters. It has been discovered that the particular surface of the electrodes can be modified to provide very specific electric fields to specific analytes of concern by altering the rise and/or run heights and/or widths.

Therefore, for example, a method is provided for optimizing mass separation within a mass selective detector. The method can include providing mass separation parameters such as the electric field parameters described above, and then providing one set of electrodes within a separator having a surface operatively aligned with the separator. The method can provide that the surface of the electrode in one cross section can define at least two runs associated via a rise, with the rise being orthogonally related to the runs. The method can also provide modifying one or both of the rises and/or runs to achieve the mass separation parameters desired.

In this fashion, for example, electrodes can be milled with specific geometries to provide specific mass separation parameters. According to one such example, a desired mass separation parameter can be achieved using one set of electrodes that are fixed in orientation within the mass selective detector. These electrodes can be removed, and another set of electrodes can be placed within the same fixed orientation. However, this other set of electrodes can have a different step rise or rise and run geometry. This allows for the operator to achieve a different mass separation parameter that may be focused and related to specific geometrically designed electrodes. With regard to the mass separation parameters that may be applied or desired, reference is made to U.S. Pat. No. 7,294,832 the entirety of which is incorporated by reference herein.

In accordance with implementation of the present disclosure, the effect of altering the width of the first step of the stepped electrode geometry on higher-order electric fields is shown in FIGS. 6A-6C, and the effect of altering the second step of the stepped electrode geometry is shown in FIGS. 7A-7C, and the third step is shown in FIGS. 8A-8C.

In compliance with the statute, embodiments of the present disclosure have been described in language more or less specific as to structural and methodical features. It is to be understood, however, that the entire invention is not limited to the specific features and/or embodiments shown and/or described, since the disclosed embodiments comprise forms of putting the invention into effect.

The invention claimed is:

1. A mass separator comprising at least one electrode component having a surface operatively aligned within the separator, the surface, in one cross section, defining at least two runs associated via at least one rise, the rise being orthogonally related to the runs, wherein the at least two runs include a first run being between 2 and 3.5 mm, and a second run being between 5.5 and 7.5 mm.

2. The separator of claim 1 wherein the surface, in the one cross section, further defines another rise extending from at least one of the runs.

3. The separator of claim 2 wherein the surface, in the one cross section, further defines a pedestal comprised by at least two of the rises and a run.

4. The separator of claim 1 wherein the surface, in the one cross section, defines opposing rises and runs.

5. The separator of claim 4 wherein the opposing rises and runs define a pedestal upon the surface of the electrode.

6. The separator of claim 5 wherein an opening is defined within the pedestal, the opening extending through to the electrode component to an opposing surface of the electrode component.

7. A mass selective detector comprising at least a first pair of opposing electrodes, each of the opposing electrodes having a complimentary surface, the surface, in one cross section, defining at least two runs associated via a rise, the rise being orthogonally related to the runs, wherein the at least two runs include a first run being between 2 and 3.5 mm, and a second run being between 5.5 and 11 mm.

8. The mass selective detector of claim 7 further comprising a second pair of opposing electrodes, individual ones of the first pair adjacent and orthogonal to the second pair.

9. The mass selective detector of claim 8 wherein at least one of the electrodes of the detector defines and opening extending between opposing surfaces of the electrode.

10. The mass selective detector of claim 7 wherein at least one of the electrodes of the detector defines an opening extending between opposing surfaces of the electrode.

11. The mass selective detector of claim wherein both the opposing electrodes of the detector define complimentary openings extending between opposing surfaces of each individual electrode.

12. The mass selective detector of claim 7 wherein the first pair of electrodes are configured as electrodes of a linear ion trap.

13. The mass selective detector of claim 7 wherein the first pair of electrodes are fixed in relation to one another via opposing end caps.

14. The mass selective detector of claim 13 wherein each of the opposing end caps define an opening, the openings of the end caps aligned with one another.

15. A mass selective detector comprising at least a first pair of opposing electrodes, each of the opposing electrodes having a complimentary surface, the surface, in one cross section, defining first and second runs associated via a first rise, and a pedestal defined by a second rise extending from the second run, the rises being orthogonally related to the runs, wherein the first run is less in cross-sectional length than the second run.

16. The mass selective detector of claim 15 wherein the pedestal comprises a third run supported by two second rises, the third run being greater than either of first or second runs.

17. The mass selective detector of claim 15 further comprising an opening extending through each of the pedestals.

18. The mass selective detector of claim 15 wherein the first run is between 2 and 3.5 mm, and the second run is between 5.5 and 7.5 mm.

19. The mass selective detector of claim 16 wherein the third run is greater than the sum of one first run and one second run.

20. The mass selective detector of claim 16 wherein the third run is between 9 and 11 mm.

* * * * *